US007296905B2

(12) United States Patent
Etter et al.

(10) Patent No.: US 7,296,905 B2
(45) Date of Patent: Nov. 20, 2007

(54) POWER TOOL WORK LIGHT

(75) Inventors: Mark A. Etter, Humboldt, TN (US); Brent Stafford, McLemoresville, TN (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 11/122,781

(22) Filed: May 5, 2005

(65) Prior Publication Data

US 2006/0104053 A1 May 18, 2006

Related U.S. Application Data

(60) Provisional application No. 60/568,355, filed on May 5, 2004.

(51) Int. Cl.
*B25B 23/18* (2006.01)

(52) U.S. Cl. ..... 362/119; 362/190; 362/287

(58) Field of Classification Search ..... 362/109, 362/119, 190, 253, 287, 269, 648
See application file for complete search history.

(56) References Cited

U.S. PATENT DOCUMENTS 5,541,822 A * 7/1996 Bamber ..... 362/190
6,565,227 B1 * 5/2003 Davis ..... 362/119
2005/0157489 A1 * 7/2005 Oomori et al. ..... 362/119

* cited by examiner

*Primary Examiner*—Ali Alavi
*Assistant Examiner*—Evan Dzierzynski
(74) *Attorney, Agent, or Firm*—Mehul R. Jani; Adan Ayala; Chares Yocum

(57) ABSTRACT

A work light for a power tool. In an exemplary embodiment, the work light includes a generally cylindrical housing constructed for receiving a light source. The housing includes a pin generally transverse to the housing and unitary with such housing. Further, an electrical coupling is configured to provide electricity to the light source from a power tool electrical source and is integrated with the electrical source. Additionally, a bracket including a flange with a plurality of apertures for receiving a series of fasteners for mounting the bracket to an external surface of the power tool is included. The bracket defines a recessed structure for receiving the pin and includes a pair of recesses spaced apart to retain a first end of the pin and a second end of the pin. The pin included within the housing permits linear positioning of the housing along an axis generally perpendicular to the pin.

13 Claims, 4 Drawing Sheets

POWER TOOL WORK LIGHT

CROSS-REFERENCE TO RELATED APPLICATIONS

The present application claims the benefit under 35 U.S.C. § 119(e) of U.S. Provisional Application Ser. No. 60/568,355, filed May 5, 2004 which is herein incorporated by reference in its entirety.

FIELD OF INVENTION

The present invention relates to the field of power tools and particularly to a work light for power tools.

BACKGROUND OF THE INVENTION

Often power tools are operated in areas which do not provide adequate over-head lighting. For example, a do-it-yourself woodworker often converts a portion of a garage into a home machine or woodworking shop. However, a typical garage includes little, if any, over-head lighting which causes the user to operate the machines without adequate lighting or to purchase additional light sources (e.g. halogen work lamps). The operation of machines without the proper lighting may lead to inferior positioning and thus, inferior work product. Further, the purchasing of additional light sources such as halogen work lamps is not only costly, but such sources generate large quantities of heat making the work environment non-conducive for long periods of work. Further, such light sources may not provide the light at a sufficient quantity to the desired area. Thus, additional solutions are necessary to address the need for adequate lighting during power tool operation.

Presently, the need for providing sufficient lighting to a given work area while operating a power tool has been addressed by integrating a work light within the power tool. Although the integration of a work light into a given power tool appeared to solve the problem of inadequate lighting to a specific work area, currently available integrated light systems are inadequate for several reasons. For example, the light source integrated into a drill press is typically recessed in the main body of the head assembly (included in the drill press) behind the drill press bit. Such positioning is disadvantageous for the light source projects light onto the drill bit causing a shadow of the drill bit to be cast upon a portion of the work area in need of illumination. The larger the size of bit, the larger shadow created. Further, such light sources are non-adjustable which prevents the user from directing the light to the desired work area.

Therefore, it would be desirable to provide a power tool with an integrated adjustable light source which supplies unobstructed light to a desired work area.

SUMMARY OF THE INVENTION

Accordingly, the present invention is directed to a work light for a power tool. The present work light may be implemented with a variety of power tools including a drill press, a scroll saw, a table saw, a band saw and the like. The work light of the instant invention provides a power tool with an integrated adjustable light source which supplies unobstructed light to a desired work area.

In accordance with a first aspect of the present invention, a work light for a power tool is provided. In an exemplary embodiment, the work light includes a housing constructed for receiving a light source. The housing may include a pin generally transverse to the housing. Further, in the embodiment, an electrical coupling is configured to provide electricity to the light source from a power tool electrical source. The electrical coupling may be configured to integrate with the power tool's electrical system. Additionally, the present embodiment includes a bracket for mounting the housing to an external surface of the power tool. The bracket defines a recessed structure for receiving the pin. Thus, the housing pin permits linear positioning of the housing along an axis generally perpendicular to the pin.

In a further aspect of the present invention, the pin is integral to the housing. In an embodiment, the bracket includes a cross member which contours at least partially for capturing a middle portion of the pin. Moreover, the recessed structure within the bracket may include a pair of recesses spaced apart to retain a first end of the pin and a second end of the pin. In further embodiments, a lens is coupled to the housing generally opposite of the pin for protecting the light source. Additionally, the housing may include an outer surface which is textured for aiding the user in manipulating the housing. For example, the outer surface of the housing may include a series of ribs.

In accordance with an additional aspect of the present invention, a work light for a power tool is provided. In an exemplary embodiment, the work light includes a generally cylindrical housing constructed for receiving a light source. The housing includes a pin generally transverse to the housing. Such pin is unitary with the housing. Further, an electrical coupling is configured to provide electricity to the light source from a power tool electrical source so that the electrical coupling integrates with the power tool electrical source. Additionally, a bracket for mounting the housing to an external surface of the power tool is included. The bracket includes a flange with a plurality of apertures for receiving a series of fasteners for mounting the bracket to the external surface of the power tool. Moreover, the bracket defines a recessed structure for receiving the pin. As such, the recessed structure within the bracket includes a pair of recesses spaced apart to retain a first end of the pin and a second end of the pin. In addition, the housing and bracket may be configured to allow incremental movement of the housing. For example, the pair of recesses as well as the first end and the second end of the pin may include teeth which assist the user in securing the work light housing in a desired orientation.

It is to be understood that both the foregoing general description and the following detailed description are exemplary and explanatory only and are not necessarily restrictive of the invention as claimed. The accompanying drawings, which are incorporated in and constitute a part of the specification, illustrate an embodiment of the invention and together with the general description, serve to explain the principles of the invention.

BRIEF DESCRIPTION OF DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Figure 1:
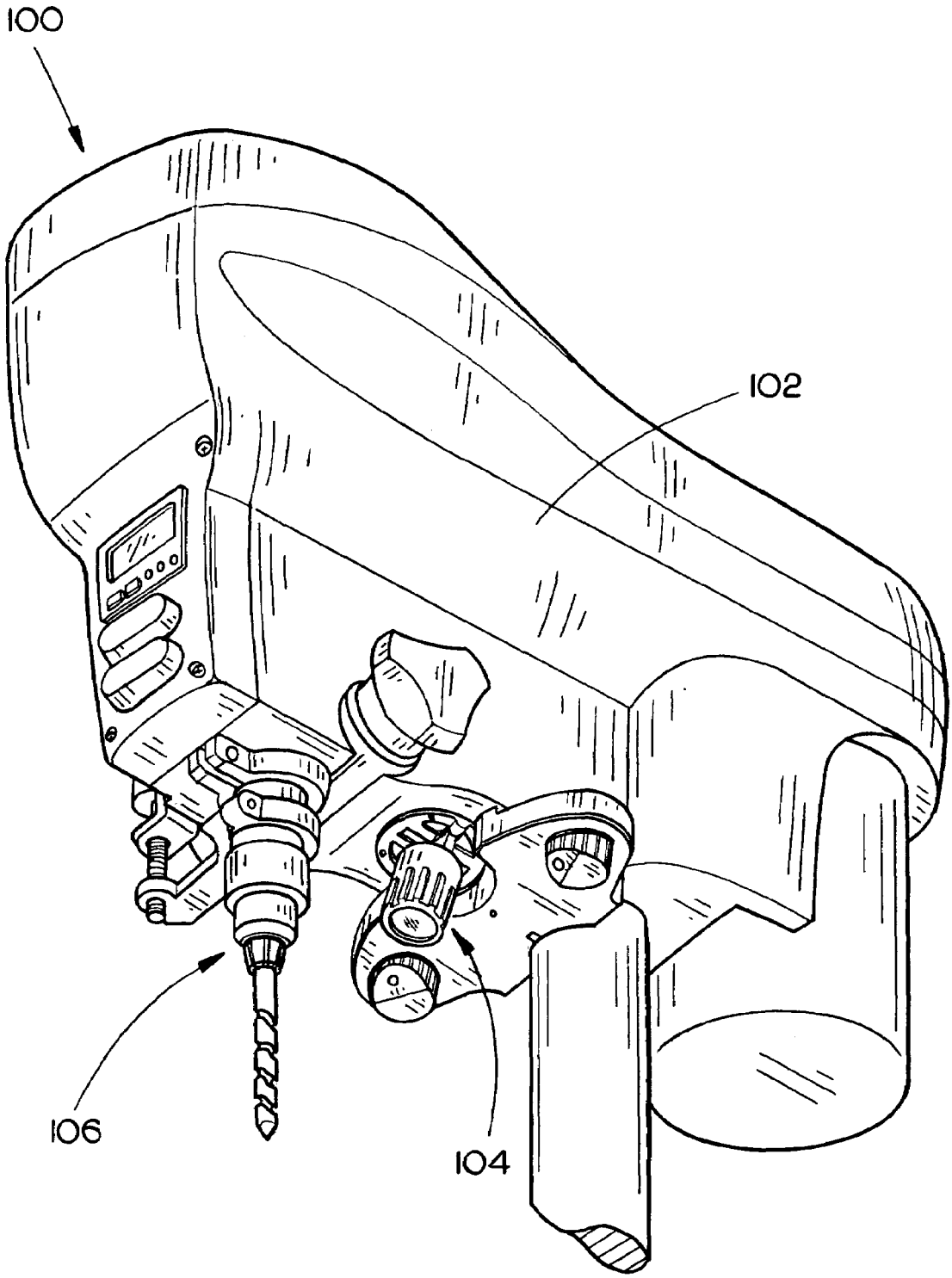
FIG. 1 is a partial isometric view of a drill press assembly in accordance with the present invention, wherein the drill press assembly includes a head assembly to which a work light is externally mounted.

Referring to FIG. 1, a drill press assembly 100 including an externally mounted, integral work light in accordance with the present invention is provided. As illustrated in FIG. 1, in an exemplary embodiment, the drill press assembly 100 includes a head assembly housing 102 for substantially enclosing a drill press head assembly. Further, a work light 104 is mounted to the head assembly housing 102 for providing light to a desired work area (e.g. a drill press table). In the present embodiment, the work light 104 is mounted behind the drill bit assembly 106 to prevent the work light 104 from interfering with the assembly 106.

Figure 2A:
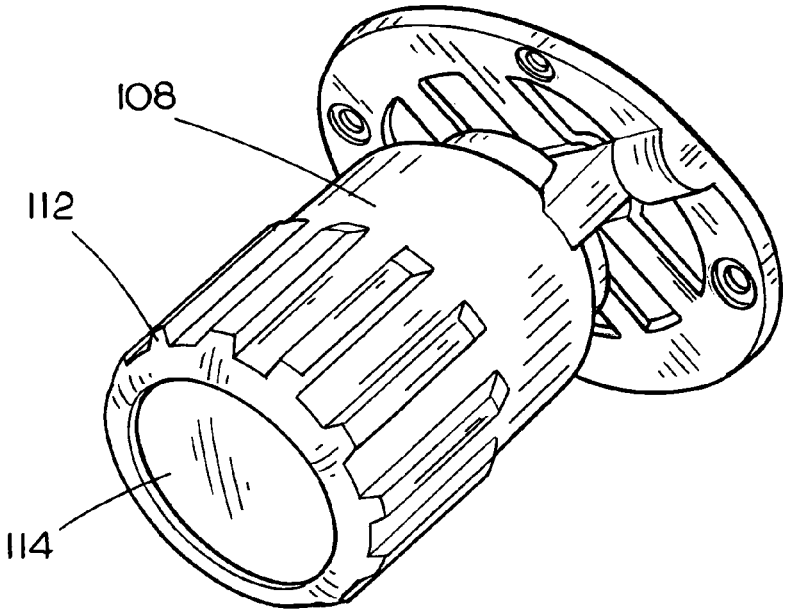
FIG. 2A is an isometric view of a work light in accordance with the present invention, wherein the work light includes a generally cylindrical shaped housing.

As illustrated in FIG. 2A, an exemplary embodiment of the work light 104 is described. In the present embodiment, the work light 104 includes a work light housing 108 constructed for receiving a light bulb 136 (e.g. an incandescent light bulb, a halogen light bulb, or the like). Alternatively, the work light housing 108 may be configured for other light emitting devices such as a light emitting diode (LED), multiple LEDS, or a combination of light sources may be utilized. In an embodiment, the work light housing 108 is generally conical or cylindrically shaped (such as with an enclosed end).

Figure 2B:
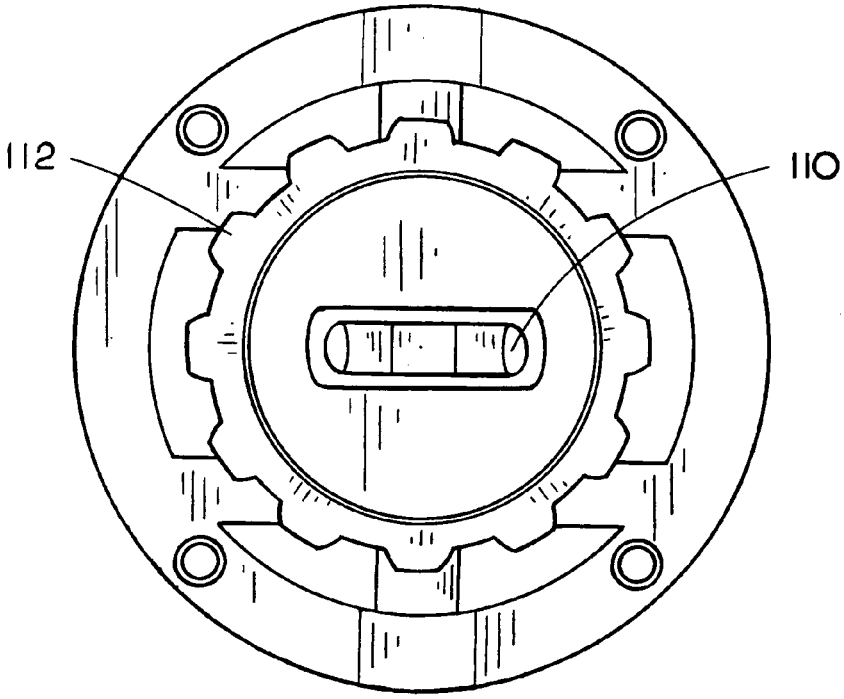
FIG. 2B is a bottom view of a work light in accordance with the present invention, wherein the work light includes an aperture for allowing airflow cooling of the light source.

In further exemplary embodiments, as illustrated in FIG. 2B, an aperture or series of apertures 110 may be included in the work light housing 108 adjacent a closed end to allow for airflow cooling of the light source. For example, a cylindrical work light housing may minimize intrusion into the area adjacent the working tool (e.g. a drill bit) while allowing for easy manipulation or positioning of the work light housing. In further embodiments, the work light housing 108 may include additional light emitting components such as a coherent light source. In the current embodiment, the work light housing 108 may be formed of a sufficiently rigid plastic, an impregnated plastic/composite material, or the like to prevent damage to the light source while permitting efficient molding or formation.

With continued reference to FIGS. 2A and 2B, in an embodiment, the outer surface of the work light housing 108 may include a series of raised ribs 112, surface texturing, or a surface coating for aiding a user in manipulating the work light housing 108. In addition to assisting a user in manipulating the work light housing 108, a gripping surface such as ribs or texturing allows for easy cleaning and minimizes dust collecting on the surface of the work light housing.

Figure 3:
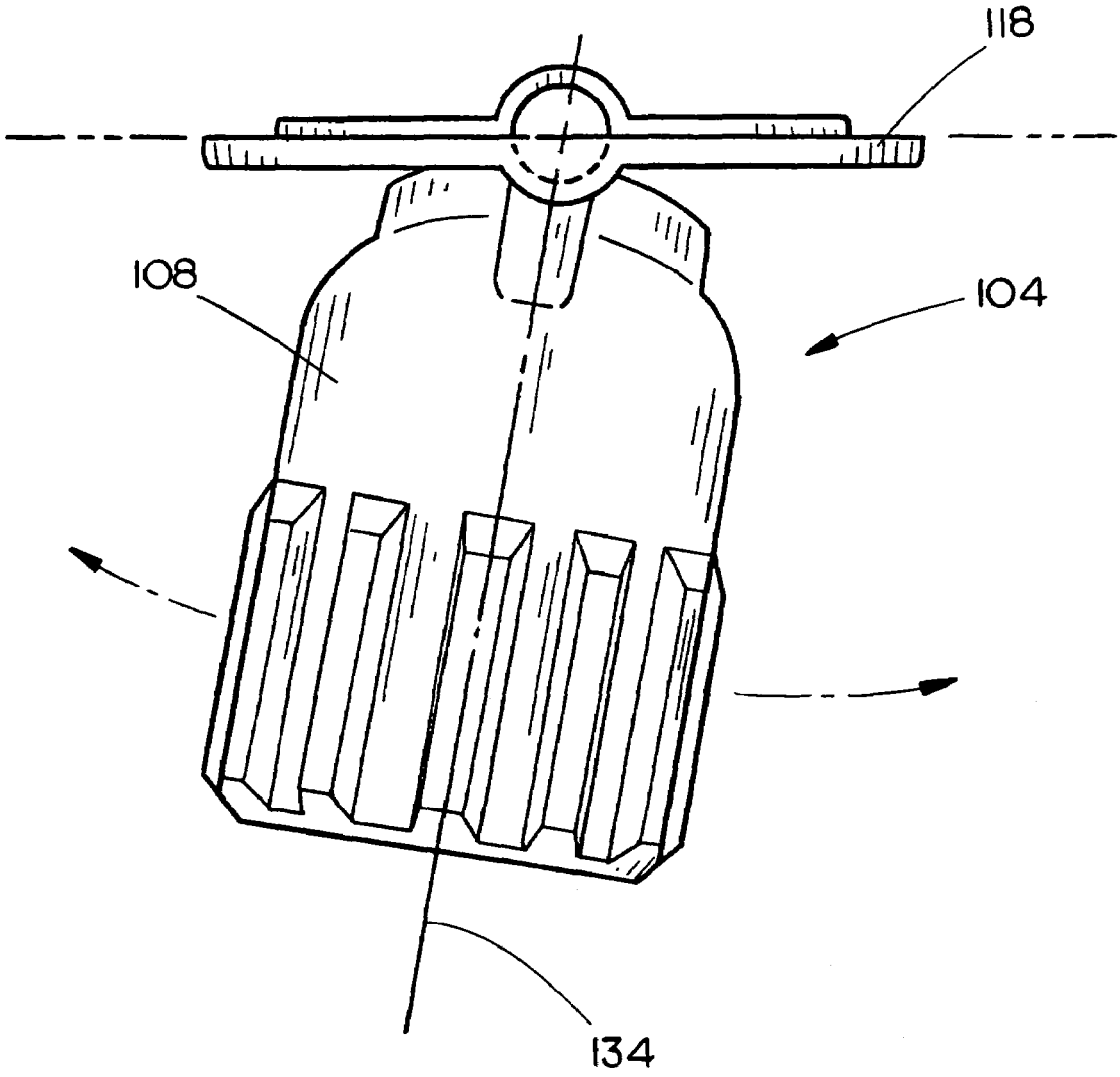
FIG. 3 is a side elevational view of a work light in accordance with the present invention, wherein the work light includes a housing pin which permits linear positioning of the housing along an axis generally perpendicular to the pin.
Figure 4:
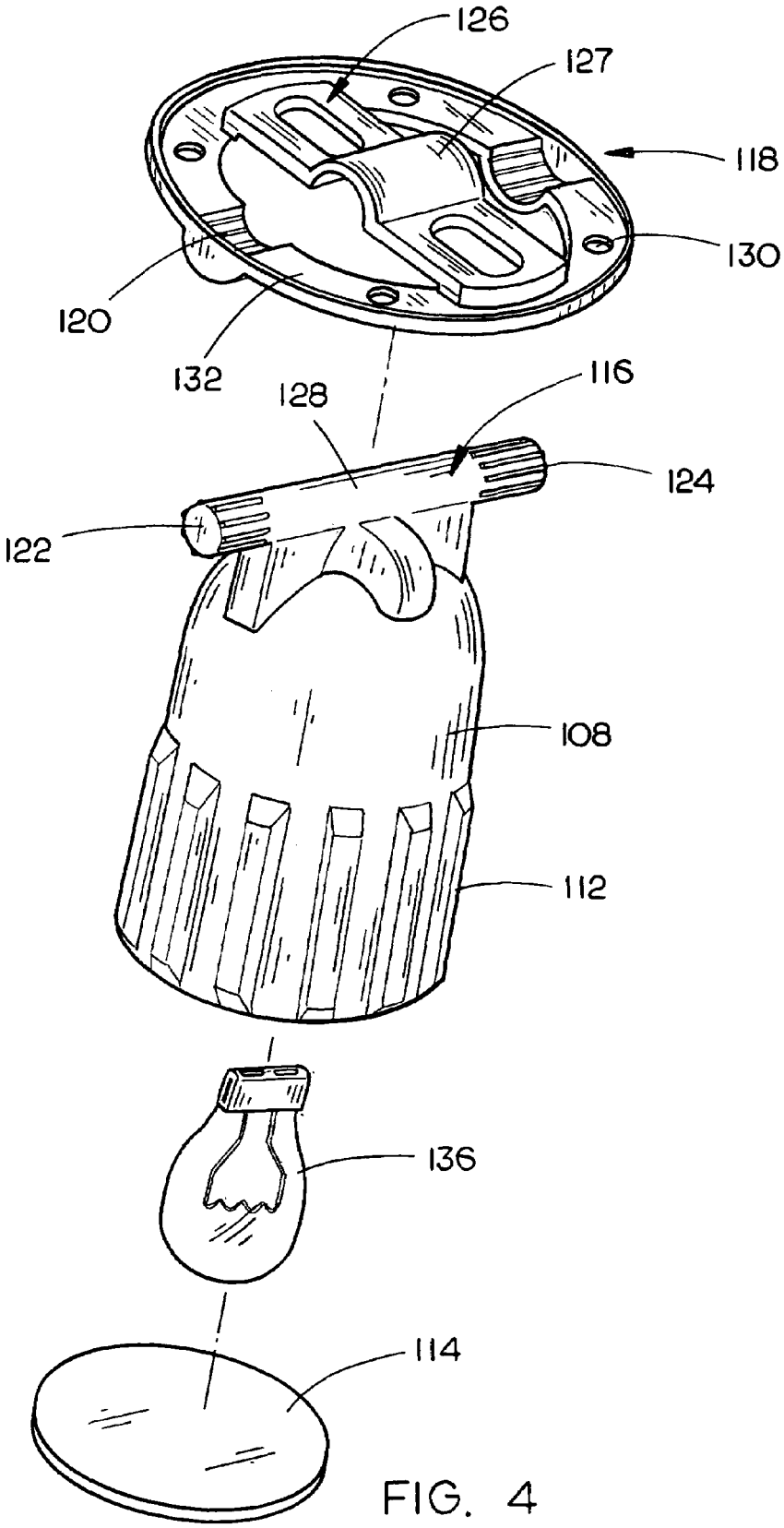
FIG. 4 is an exploded view of the work light illustrated in FIG. 3, wherein the work light includes a bracket for mounting the work light to the drill press assembly.

In an embodiment, as illustrated in FIG. 4, a pin or rod 116 is included on one end of the work light housing 108. In such embodiment, the pin 116 is unitary with the work light housing 108 and extends transverse to the main body of the work light housing 108. Forming the pin 116 unitary with the work light housing 108 may allow for simplified construction and minimize the number of components. In the foregoing manner, using the pin or rod 116, the work light housing 108 may be swept or positioned at various orientations generally perpendicular to the pin 116 (when retained in a bracket, i.e., perpendicular to the longitudinal axis), so as to position the work light housing 108 with respect to the working tool (e.g. drill bit) as well as the desired work area (e.g. a drill press table or the like). See FIG. 3.

In an additional embodiment, as illustrated in FIGS. 2A and 4, a lens 114 may be attached to the work light housing 108 generally opposite to the end of the work light housing 108 including the pin 116. Such attachment may occur via a screw threading, a snap or compression fit, a retaining clip, or the like. The lens 114 may minimize dust collecting in the work light housing 108 to prevent the light source from being damaged or may be utilized to focus the projected/emitted light. In addition, a bezel may be included on the end of the work light housing 108 including the lens 114 for adjusting the lens allowing the light source to be focused.

Referring to FIG. 4, an exemplary embodiment of the work light 104 including a bracket 118 for mounting the work light 104 to the drill press assembly 100 is provided. In such embodiment, the bracket 118 is included for mounting the work light 104 to an external surface of the head assembly housing 104 of the drill press assembly 100. In an embodiment, the bracket 118 includes a recess (e.g., a partial cylindrical recess or pocket) for capturing an end of the pin 116. For example, as illustrated in FIG. 3, the bracket 118 includes a pair of recess structures denoted generally as 120 spaced sufficiently apart to retain a first end 122 and a second end 124 of the pin 116, while providing sufficient distance between the recess/end wall of the recess to allow for insertion of the pin 116 into the bracket 118 during manufacturing or replacement (e.g., snap fitting).

In additional exemplary embodiments, as illustrated in FIG. 3, the bracket 118 includes a cross member 126 which forms a contour 127 for capturing a middle portion 128 of the pin 116 (such as by including a corresponding concave structure for the pin). In an embodiment, the cross member 126 is formed so as to retain the pin 116 in a snap fit fashion. Further, the cross member 126 and/or end recess structures 120 may be configured to frictionally secure the pin 116 to ensure that the work light housing 108 is retained in the desired orientation.

In an exemplary embodiment, as illustrated in FIG. 4, the cross member 126 is unitary with the bracket 118. In other embodiments, the cross member 126 may be retained against a power tool surface via an outer flange recess or the like. For example, in an embodiment, the work light 104 may be secured or mounted to the power tool via a series of fasteners such as screws extending through apertures 130 present within a flange 132 formed as part of the bracket 118. Alternatively, the bracket 118 may be secured via adhesive, or include a magnet for coupling to a magnetically permeable material such as the steel head of a drill.

In the present embodiment, the bracket 118 is generally circular and may be formed so that the cross member 126 and end recess structures 120 are formed with a flat mounting surface. In additional embodiments, an elastomeric strip or corresponding teeth included on the bracket/pin may be utilized to assist in securing the housing in a desired orientation. As provided in FIG. 4, the presence of teeth on the pair of recesses 120 as well as the first end 122 and second end 124 of the pin 116 may allow a user to incrementally adjust the work light housing 108 to a desired orientation.

In further embodiments, an electrical coupling is configured to provide electricity to the light source from a drill press electrical source so to integrate the light source of the work light 104 with the drill press electrical source. For example, to "hard wire" the work light 104 to the drill press assembly 100 a stop may be included to prevent a power cord or wiring from becoming crimped or twisted during movement of the work light housing 108. Additionally, corresponding contact plates or rings may be utilized to transfer power to the work light 104.

Although an exemplary embodiment of the present invention integrates the work light with an electrical source disposed within the power tool, it is contemplated that the work light may be powered by a battery such as by disposable batteries, a re-chargeable battery (such as implemented with a cordless power tool) or the like. It is further contemplated that the electricity may be provided to the work light via a standard electrical connection directly to an outlet (such as a wall outlet).

Referring to FIG. 3, an exemplary embodiment of the work light 104 is provided which illustrates the linear positioning of the housing along an axis generally perpendicular to the pin. As illustrated in FIG. 3, the use of the pin or rod 116 allows a user to position the work light housing 108 at various orientations generally perpendicular to the pin 116 (when retained in a bracket, i.e., perpendicular to the longitudinal axis 134). Such feature is advantageous for it allows the work light housing 108 to be positioned with respect to the working tool (e.g. drill bit) as well as the desired work area (e.g. drill press table 106 or the like). As previously mentioned, the positioning may be incremental by including teeth on the pair of recesses 120 as well as the first end 122 and second end 124 of the pin 116.

In a further exemplary embodiments of the present invention, an inner ring or disk mounting bracket may be utilized to allow for rotation of the work light housing 108 in addition to the previously described sweeping, linear motion of the work light housing 108. For example, an outer ring having a flange or lip for holding the inner ring such that the inner ring may rotate. In such embodiment, a stop may be included to prevent a power cord or wiring from becoming crimped or twisted during movement of the work light housing.

Although the present disclosure focuses upon the use of the instant invention with a drill press, it is contemplated that the disclosed work light may be utilized with a variety of power tools including a scroll saw, a table saw, a band saw and the like without departing from the scope and spirit of the present invention.

It is believed that the present invention and many of its attendant advantages will be understood by the foregoing description, and it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A work light for a power tool, comprising:

a generally cylindrical housing constructed for receiving a light source, the housing including a pin generally transverse to the housing, the pin being unitary with the housing;

an electrical coupling configured to provide electricity to the light source from a power tool electrical source, the electrical coupling being configured to integrate with the power tool electrical source; and a bracket being configured to mount the generally cylindrical housing to an external surface of the power tool, the bracket including a flange with a plurality of apertures for receiving a series of fasteners for mounting the bracket to the external surface of the power tool and the bracket defining a recessed structure for receiving the pin, the recessed structure within the bracket including a pair of spaced apart recesses to retain a first end of the pin and a second end of the pin, wherein the pin included within the housing permits linear positioning of the housing along an axis generally perpendicular to the pin.

2. The work light for a power tool as claimed in claim 1, wherein the bracket includes a cross member which at least partially contours for capturing a middle portion of the pin.

3. The work light for a power tool as claimed in claim 1, further comprising a lens coupled to the housing generally opposite of the pin included within the housing for protecting the light source.

4. The work light for a power tool as claimed in claim 1, wherein the housing includes an outer surface which is at least partially textured for aiding the user in manipulating the housing.

5. The work light for a power tool as claimed in claim 1, wherein the housing includes an outer surface defining a series of ribs.

6. The work light for a power tool as claimed in claim 1, wherein the housing and bracket are configured to allow incremental movement of the housing.

7. The work light for a power tool as claimed in claim 1, wherein the pair of recesses spaced apart recesses includes teeth; the first end of the pin and the second end of the pin include corresponding teeth which assist the user in securing the work light housing in a desired orientation.

8. A drill press including a work light, comprising:

a head assembly housing for substantially enclosing a drill press head assembly; and a work light mounted to the head assembly housing for providing light to a desired work area, the work area including a drill press table and the work light including:

a generally cylindrical work light housing constructed for receiving a light source, the work light housing including a pin generally transverse to the work light housing, the pin being unitary with the work light housing; an electrical coupling configured to provide electricity to the light source from a drill press electrical source, the electrical coupling being configured to integrate with the drill press electrical source; and a bracket for mounting the work light housing to an external surface of the head assembly housing, the bracket including a flange with a plurality of apertures for receiving a series of fasteners for mounting the bracket to the external surface of the head assembly housing and the bracket defining a recessed structure for receiving the pin, the recessed structure within the bracket including a pair of spaced apart recesses to retain a first end of the pin and a second end of the pin, wherein the pin included within the work light housing permits linear positioning of the work light housing along an axis generally perpendicular to the pin.

9. The drill press including a work light as claimed in claim 8, wherein the bracket includes a cross member which at least partially contours for capturing a middle portion of the pin.

10. The drill press including a work light as claimed in claim 8, further comprising a lens coupled to the work light housing generally opposite of the pin included within the work light housing for protecting the light source.

11. The drill press including a work light as claimed in claim 8, wherein the work light housing includes an outer surface which is at least partially textured for aiding the user in manipulating the work light housing.

12. The drill press including a work light as claimed in claim 8, wherein the work light housing includes an outer surface defining a series of ribs.

13. The drill press including a work light as claimed in claim 8, wherein the pair of spaced apart recesses include teeth; the first end of the pin and the second end of the pin include corresponding teeth which assist the user in securing the work light housing in a desired orientation.

* * * * *